US006452581B1

(12) United States Patent
Katakura et al.

(10) Patent No.: US 6,452,581 B1
(45) **Date of Patent: *Sep. 17, 2002**

(54) DRIVING METHOD FOR LIQUID CRYSTAL DEVICE AND LIQUID CRYSTAL APPARATUS

(75) Inventors: Kazunori Katakura, Atsugi; Shinjiro Okada, Isehara; Akira Tsuboyama, Sagamihara; Jun Iba, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/058,205

(22) Filed: Apr. 10, 1998

(30) Foreign Application Priority Data

Apr. 11, 1997 (JP) ..... 9-093317

(51) Int. Cl.[7] ..... G09G 3/36
(52) U.S. Cl. ..... 345/101; 345/97
(58) Field of Search ..... 345/204, 97, 101

(56) References Cited

U.S. PATENT DOCUMENTS

| | | | | |
|---|---|---|---|---|
| 4,367,924 | A | 1/1983 | Clark et al. | 350/334 |
| 4,674,839 | A | 6/1987 | Tsuboyama et al. | 350/344 |
| 4,738,515 | A | 4/1988 | Okada et al. | 350/350 S |
| 4,778,260 | A | 10/1988 | Okada et al. | 350/350 S |
| 4,800,382 | A | 1/1989 | Okada et al. | 340/784 |
| 4,844,590 | A | 7/1989 | Okada et al. | 350/350 S |
| 4,902,107 | A | 2/1990 | Tsuboyama et al. | 350/350 S |
| 4,917,470 | A | 4/1990 | Okada et al. | 350/333 |
| 4,923,285 | A | 5/1990 | Ogino et al. | 350/331 T |
| 4,958,915 | A | 9/1990 | Okada et al. | 350/345 |
| 4,973,135 | A | 11/1990 | Okada et al. | 350/334 |
| 5,026,144 | A | 6/1991 | Taniguchi et al. | 350/350 S |
| 5,033,822 | A | 7/1991 | Ooki et al. | 350/331 T |
| 5,041,821 | A | 8/1991 | Onitsuka et al. | 340/784 |
| 5,058,994 | A | 10/1991 | Mihara et al. | 359/56 |
| 5,321,419 | A | 6/1994 | Katakura et al. | 345/97 |
| 5,379,138 | A | 1/1995 | Okada | 359/56 |
| 5,446,570 | A | 8/1995 | Kaneko et al. | 359/87 |
| 5,469,281 | A | 11/1995 | Katakura et al. | 359/56 |

(List continued on next page.)

FOREIGN PATENT DOCUMENTS

| | | | |
|---|---|---|---|
| JP | 56-107216 | 8/1981 | |
| JP | 59-193426 | 11/1984 | |
| JP | 59-193427 | 11/1984 | |
| JP | 60-156046 | 8/1985 | |
| JP | 60-156047 | 8/1985 | |
| JP | 5-158444 | * 6/1993 | G09G/3/36 |

OTHER PUBLICATIONS

Japanese Journal of Applied Physics, "Direct Method with Triangular Waves for Measuring Spontaneous Polarization in Ferroelectric Liquid Crystals", Keita Miyasato, Shigeharu Abe, Hideo Takezoe, Atsuo Fukuda and Eiichi Kuze, vol. 22, No. 10, Oct. 1983, pp. L661–L663.

*Primary Examiner*—Steven Saras
*Assistant Examiner*—William C. Spencer
(74) *Attorney, Agent, or Firm*—Fitzpatrick, Cella, Harper Scinto

(57) ABSTRACT

A liquid crystal device of the type comprising a pair of substrates and a chiral smectic liquid crystal disposed between the substrates so as to form at least one pixel, is driven by a driving method including applying a signal waveform to a selected pixel. The driving method includes the step of applying the signal waveform which includes a clear pulse for placing the liquid crystal in a first state and a writing pulse subsequent to the clear pulse for selectively placing the liquid crystal in a second state depending on input data. The writing pulse includes a higher voltage portion and a pair of lower voltage portions sandwiching the higher voltage portion. The writing pulse is effective in reducing power consumption while ensuring a wider drive margin.

6 Claims, 11 Drawing Sheets

U.S. PATENT DOCUMENTS

| | | | | |
|---|---|---|---|---|
| 5,471,229 | A | 11/1995 | Okada et al. | 345/89 |
| 5,506,601 | A | 4/1996 | Mihara et al. | 345/103 |
| 5,508,711 | A | 4/1996 | Okada | 345/97 |
| 5,519,411 | A | 5/1996 | Okada et al. | 345/89 |
| 5,521,727 | A | 5/1996 | Inaba et al. | 359/56 |
| 5,532,713 | A | 7/1996 | Okada et al. | 345/97 |
| 5,581,381 | A | 12/1996 | Shinjo et al. | 349/85 |
| 5,583,534 | A | 12/1996 | Katakura et al. | 345/97 |
| 5,592,190 | A | 1/1997 | Okada et al. | 345/89 |
| 5,592,191 | A | 1/1997 | Tsuboyama et al. | 345/97 |
| 5,598,229 | A | 1/1997 | Okada et al. | 348/792 |
| 5,602,562 | A | 2/1997 | Onitsuka et al. | 345/101 |
| 5,606,343 | A | 2/1997 | Tsuboyama et al. | 345/97 |
| 5,608,420 | A | 3/1997 | Okada | 345/89 |
| 5,627,559 | A | 5/1997 | Tsuboyama et al. | 345/97 |
| 5,638,195 | A | 6/1997 | Katakura et al. | 349/143 |
| 5,646,755 | A | 7/1997 | Okada et al. | 345/97 |
| 5,650,797 | A | 7/1997 | Okada | 345/97 |
| 5,657,038 | A | 8/1997 | Okada et al. | 345/94 |
| 5,673,062 | A | 9/1997 | Katakura et al. | 345/95 |
| 5,675,354 | A | 10/1997 | Katakura et al. | 345/97 |
| 5,689,320 | A | 11/1997 | Okada et al. | 349/135 |
| 5,691,740 | A | 11/1997 | Onitsuka et al. | 345/96 |
| 5,717,421 | A | 2/1998 | Katakura et al. | 345/101 |
| 5,734,365 | A | 3/1998 | Ohno et al. | 345/97 |
| 5,734,367 | A | 3/1998 | Tsuboyama et al. | 345/101 |
| 5,754,154 | A | 5/1998 | Katakura et al. | 345/97 |

* cited by examiner

DRIVING METHOD FOR LIQUID CRYSTAL DEVICE AND LIQUID CRYSTAL APPARATUS

FIELD OF THE INVENTION AND RELATED ART

The present invention relates to a driving method for driving a chiral smectic liquid crystal device, particularly of an electrode matrix-type, and a liquid crystal apparatus including the chiral smectic liquid crystal device.

A liquid crystal device showing bistability has been proposed by Clark and Lagerwall in U.S. Pat. No. 4,367,924, Japanese Laid-Open Patent Application (JP-A) No. 56-107216, etc. As the bistable liquid crystal, a ferroelectric liquid crystal showing chiral smectic C phase (SmC*) or H phase (SmH*) is generally used. The ferroelectric liquid crystal assumes either a first optically stable state or a second optically stable state in response to an electric field applied thereto and retains the resultant state in the absence of an electric field, thus showing a bistability. Further, the ferroelectric liquid crystal quickly responds to a change in electric field, and thus the ferroelectric liquid crystal device is expected to be widely used in the field of a high-speed and memory-type display apparatus, etc.

The ferroelectric liquid crystal device generally has an electrode matrix wherein a pair of substrates are each provided with a group of stripe-shaped electrodes intersecting with each other at right angles to form a multiplicity of pixels at each intersection of the electrodes, and is driven by, e.g., driving methods described in JP-A Nos. 59-193426, 59-193427, 60-156046, 60-156047, etc.

In the above-described conventional driving methods, an electric field required for providing either the first optically stable state or the second optically stable state is decreased with an increasing temperature, thus changing a drive waveform depending on a temperature in order to maintain good display states.

The conventional driving methods, however, have been accompanied with problems in some cases when the liquid crystal device used is driven at high temperature.

More specifically, if a pulse width of the drive waveform is shortened at a high temperature, the liquid crystal device is driven at a high voltage, thus leading to a shorter response time (higher response speed) of the liquid crystal used and a larger amplitude of the drive waveform. As a result, a power consumption of the liquid crystal apparatus is increased. Further, the driving method using the higher voltage is liable to cause heat evolution or generation, thus resulting in a temperature unevenness (irregularity in temperature distribution) in a display region of the liquid crystal device.

On the other hand, if the driving voltage is lowered to suppress heat evolution, a resultant drive margin is decreased or narrowed.

SUMMARY OF THE INVENTION

An object of the present invention is to provide a driving method for a liquid crystal device having solved the above-mentioned problems and capable of providing a larger (wider) drive margin at low power consumption irrespective of temperature change while keeping good image qualities.

Another object of the present invention is to provide a liquid crystal apparatus including the liquid crystal device.

According to the present invention, there is provided a driving method for a liquid crystal device of the type comprising a pair of substrates and a chiral smectic liquid crystal disposed between the substrates so as to form at least one pixel, the driving method comprising:

applying a signal waveform to a selected pixel, wherein the signal waveform comprises a clear pulse for placing the liquid crystal in a first state and a writing pulse subsequent to the clear pulse for selectively placing the liquid crystal in a second state depending on input data, and the writing pulse comprises a higher voltage portion and a pair of lower voltage portions sandwiching the higher voltage portion.

According to the present invention, there is also provided a driving method for a liquid crystal device of the type comprising a pair of substrates and a chiral smectic liquid crystal disposed between the substrates so as to form at least one pixel, the driving method comprising:

applying a signal waveform, changed depending on a temperature of the liquid crystal device, to a selected pixel, wherein the signal waveform comprises a waveform at a high temperature including a clear pulse for placing the liquid crystal in a first state and a writing pulse subsequent to the clear pulse for selectively placing the liquid crystal in a second state depending on input data, and the writing pulse comprises a higher voltage portion and a pair of lower voltage portions sandwiching the higher voltage portion.

According to the present invention, there is further provided a liquid crystal apparatus, comprising:

a liquid crystal device comprising a pair of substrates and a chiral smectic liquid crystal disposed between the substrates so as to form at least one pixel, and signal waveform application means for applying a signal waveform to a selected pixel, wherein the signal waveform comprises a clear pulse for placing the liquid crystal in a first state and a writing pulse subsequent to the clear pulse for selectively placing the liquid crystal in a second state depending on input data, and the writing pulse comprises a higher voltage portion and a pair of lower voltage portions sandwiching the higher voltage portion.

According to the present invention, there is still further provided a liquid crystal apparatus, comprising:

a liquid crystal device comprising a pair of substrates and a chiral smectic liquid crystal disposed between the substrates so as to form at least one pixel, and signal waveform application means applying a signal waveform, changed depending on a temperature of the liquid crystal device, to a selected pixel, wherein the signal waveform comprises a waveform at a high temperature including a clear pulse for placing the liquid crystal in a first state and a writing pulse subsequent to the clear pulse for selectively placing the liquid crystal in a second state depending on input data, and the writing pulse comprises a higher voltage portion and a pair of lower voltage portions sandwiching the higher voltage portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figures 7A, 7B, 7C, 7D:
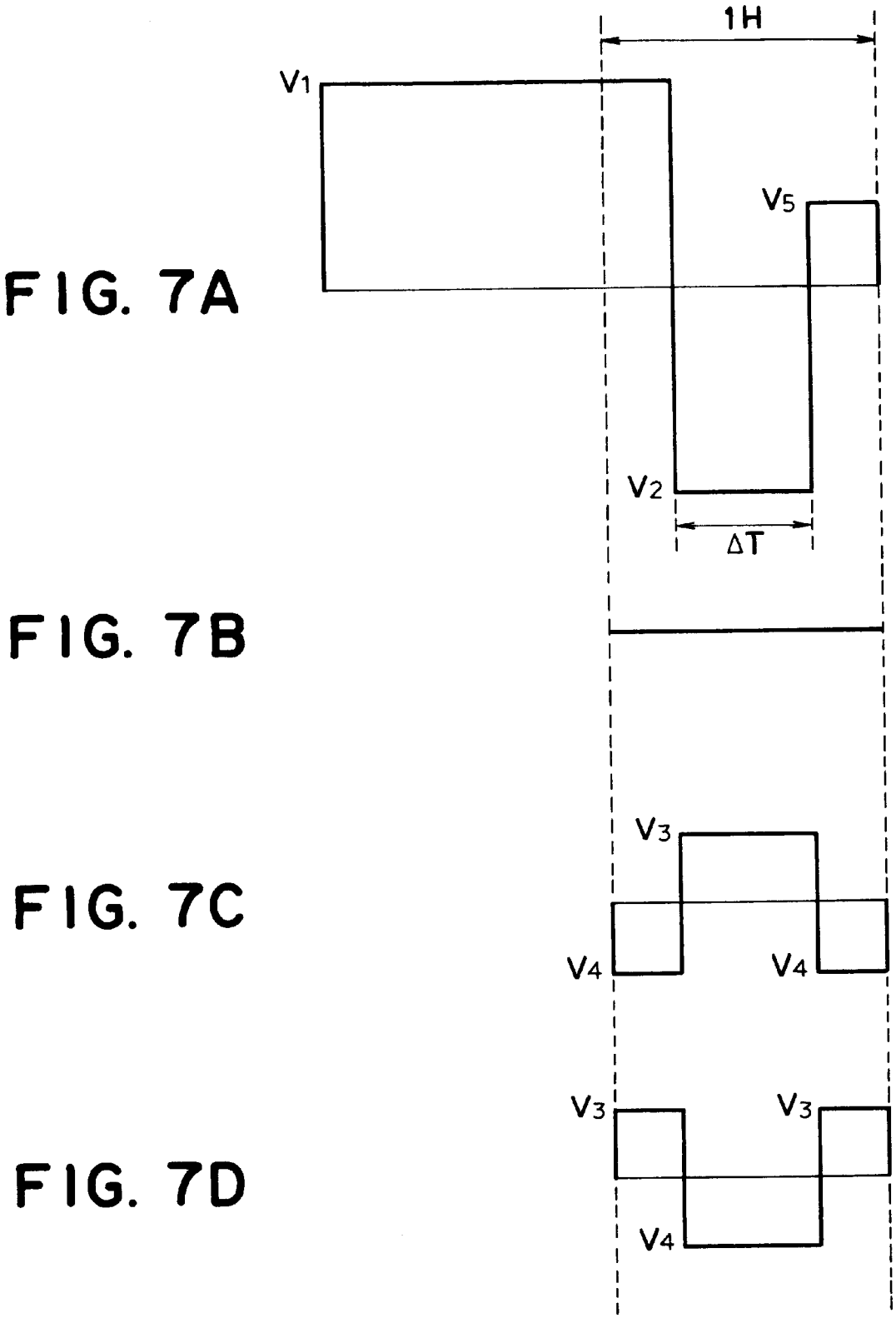
FIGS. 7A–7D are a diagram showing a set of conventional drive waveforms used for a chiral smectic (ferroelectric) liquid crystal device.
Figure 8:
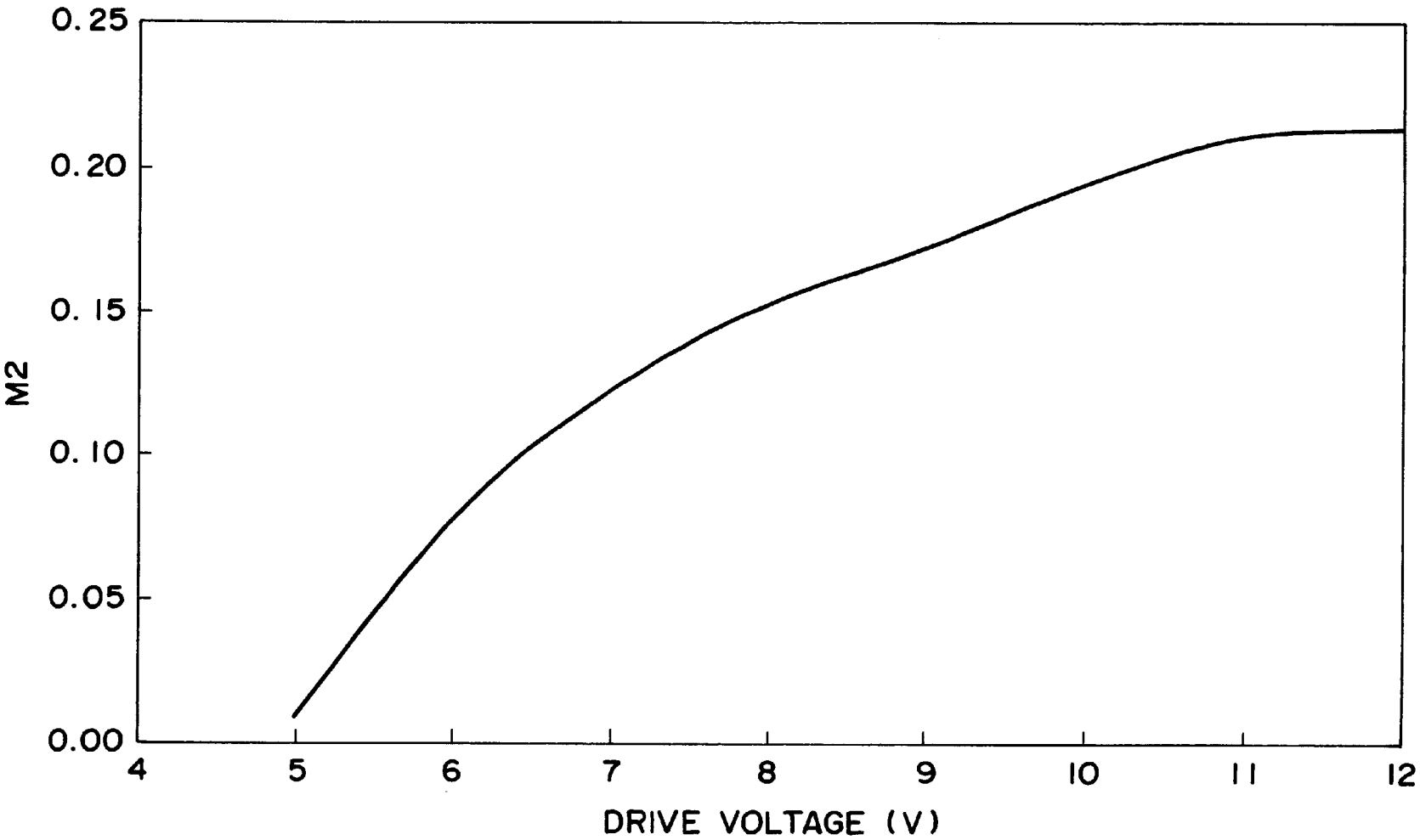
FIG. 8 is a graph showing an embodiment of a relationship between a drive voltage and a drive margin (M2) with respect to a chiral smectic (ferroelectric) liquid crystal device.

FIG. 8 shows a relationship between a drive voltage (a voltage value of a writing pulse) and a drive margin (M2) as a result of our study with respect to drive voltage values (absolute values) (|V2|+|V3|) and pulse widths of a conventional conventional writing pulse (as shown in FIGS. 7A–7D) under conditions including |V1|=|V2|,|V3|=|V4|, |V1|=|V3|×2.5,|V5|=|V3|×1.1 at 55° C. For example, in FIG. 8, when the drive voltage (|V2|+|V3|) of 10 volts, a maximum pulse width is 23.7 μsec and a minimum pulse width is 16.0 μsec for a selection pulse width (ΔT) of the writing pulse. Further, one horizontal scan period (1H) is set to be two times the value of ΔT.

As apparent from FIG. 8, the higher voltage value provides a larger (wider) drive margin (M2).

Herein, the value M2 representing the drive margin is determined according to the following equation:

$$M2=(T\max-T\min)/(T\max+T\min),$$

wherein "Tmax" represents a maximum pulse width allowing good display states (e.g., particularly capable of providing both of the first and second stable states of a chiral smectic liquid crystal in a matrix driving scheme) under application of a given drive voltage, and "Tmin" represents a minimum pulse width therefor. Specifically, the value "Tmin" corresponds to a threshold pulse width for providing the good display states and the value "Tmax" corresponds to a closstalk pulse value where a prescribed display state is unexpectedly changed to the other display state with respect to adjacent non-pixels on an identical (selected) scanning line (scanning electrode).

The value "M2×100" represents an upper limit (%) of pulse width fluctuation allowing a good matrix driving or a tolerance (%) of a distribution of a threshold pulse width within a display panel (liquid crystal device).

The larger M2 value can provide better display states to the display panel used in view of a yield factor.

With respect to the above-described relationship between the writing pulses and the pulse widths (or the drive margins M2) at high temperatures, however, if the applied voltage value is high, a resultant power consumption is increased, thus causing an unevenness (or irregularity) in temperature distribution.

As a result of our investigation as to waveforms of writing pulses while maintaining scanning signals and data signals in simpler forms, we have found that a particular writing pulse waveforms (a waveform to be applied to a selected pixel) provides a larger drive margin (M2) even at a high temperature.

Figure 9:
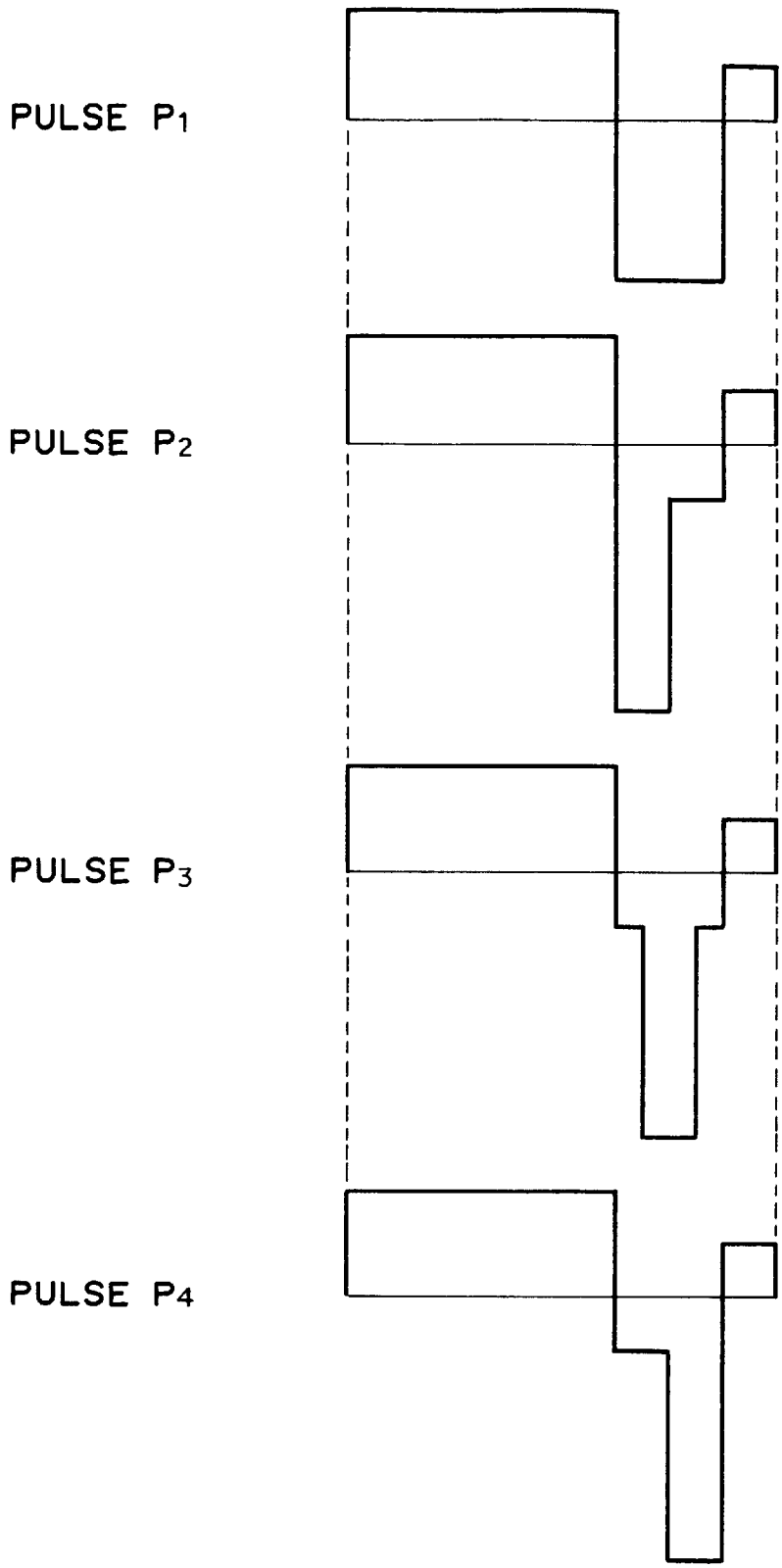
FIG. 9 shows writing pulse waveforms for pulses $P_1$–$P_4$ applied to a chiral smectic (ferroelectric) liquid crystal device.
Figure 10:
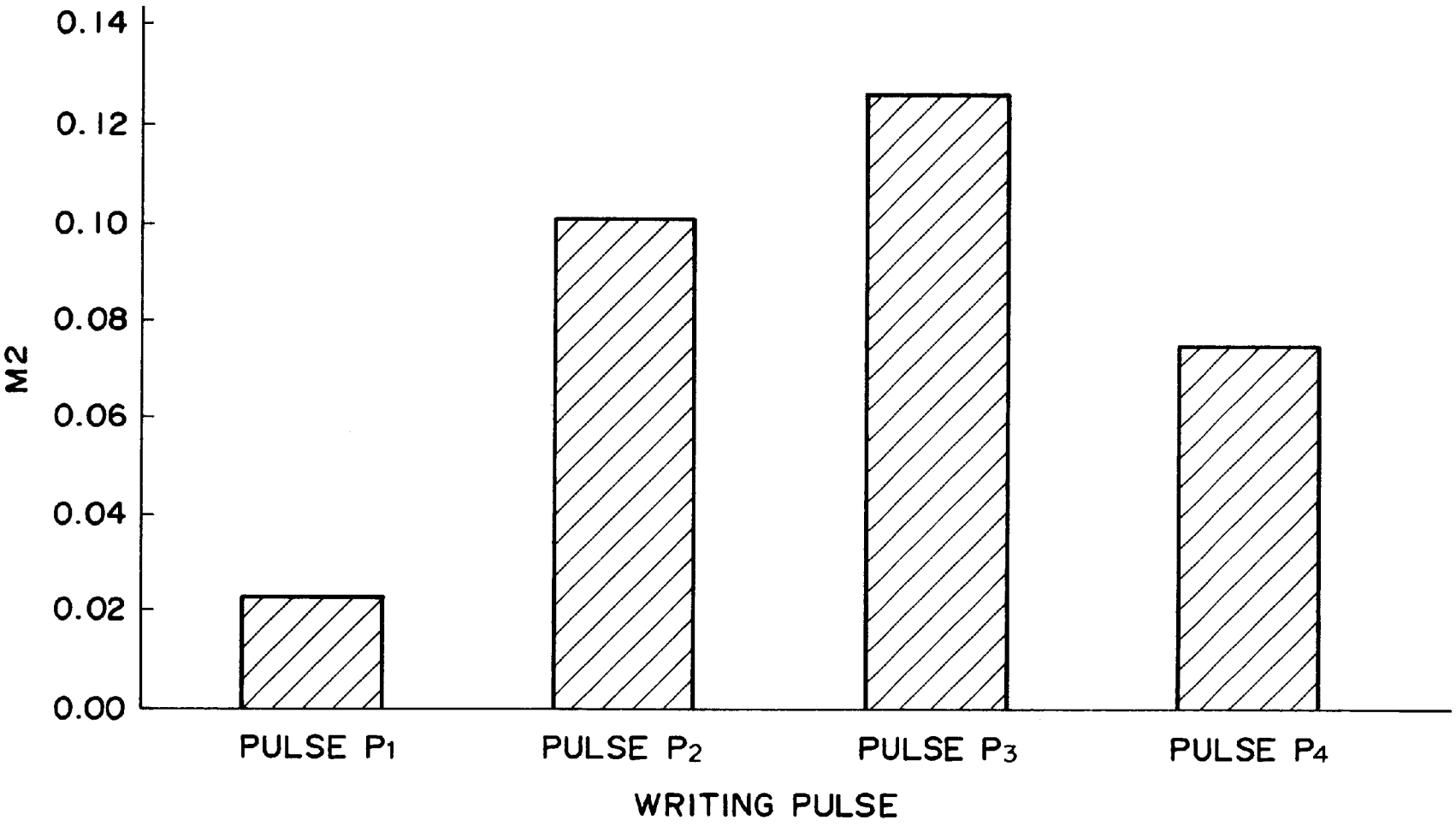
FIG. 10 is a graph showing a relationship between the pulses $P_1$–$P_4$ shown in FIG. 9 and corresponding margins (M2).

More specifically, four pulses $P_1$ to $P_4$ having waveforms including different writing pulses shown in FIG. 9, respectively, provide different drive margins (M2) shown in FIG. 10.

As apparent from these figures, the pulse $P_3$ having a waveform (shown in FIG. 9) including a clear pulse, a writing pulse subsequent to the clear pulse and an auxiliary pulse subsequent to the writing pulse, wherein the writing pulse has a central higher voltage portion and a pair of adjacent lower voltage portions sandwiching the higher voltage portion, provides the largest drive margin (M2) among the four pulses $P_1$ to $P_4$.

When the pulse $P_3$ (having the writing pulse including the higher voltage portion and the lower voltage portions sandwiching the higher voltage portion) is used, a liquid crystal used is only supplied with a minimum higher voltage required (for the good matrix driving) even at a high temperature, thus suppressing heat evolution to minimize a power consumption at the lowest level while ensuring the larger drive margin (M2).

In the present invention, the higher voltage portion of the writing pulse may appropriately be set depending upon response characteristics of a liquid crystal material used and a temperature-dependence of the drive margin (M2) in view of a correlation with the lower voltage portions before and after the higher voltage portion.

The higher voltage portion in the present invention may preferably have a voltage value (as an absolute value) which is at least two times, more preferably 2–5 times, a larger value of voltage values (as an absolute value) of the lower voltage portions. When the lower voltage portions have an identical voltage value, the (identical) voltage value is regarded herein as a "larger value".

Further, the higher voltage portion may preferably have a pulse width equal to or longer than a total pulse width of the lower voltage portions. In this regard, when the writing pulse has a pulse width of ΔT, the higher voltage portion may preferably have a pulse width of 0.5ΔT to 0.8ΔT.

Figure 1:
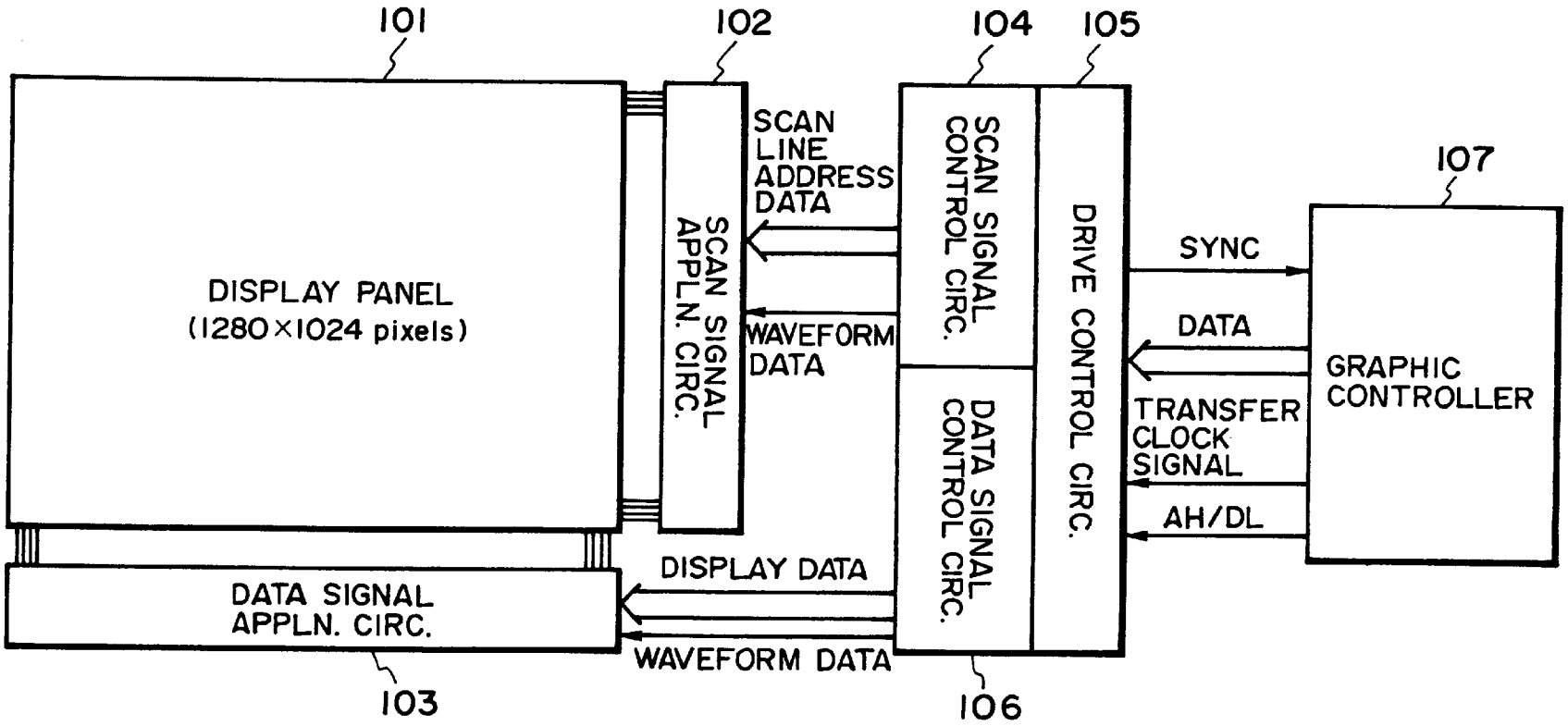
FIG. 1 is a block diagram of a liquid crystal apparatus according to the present invention.

FIG. 1 is a block diagram of an embodiment of a liquid crystal display apparatus including a liquid crystal device as a display portion or panel driven by the driving method according to the present invention.

Referring to FIG. 1, a graphic controller 107 supplies data to a drive control circuit 105. The data is then inputted to a scanning signal control circuit 104 and a data signal control circuit 103 where the data is converted into address data and display data (picture data), respectively. Based on the address data, a scanning selection signal waveform and a scanning non-selection signal waveform are generated by and supplied from a scanning signal application circuit 102 to scanning electrodes of a display portion (panel) 101 having, e.g., 1280×1024 pixels (dots). Further, based on the display data, data signal waveforms are generated by and supplied from a data signal application circuit 103 to data electrodes of the display portion 101. The drive control circuit 105 also supplies waveform data to the scanning signal application circuit 102 and the data signal application circuit 103 via the scanning signal control circuit 104 and the data signal control circuit 106, respectively.

Figure 2:
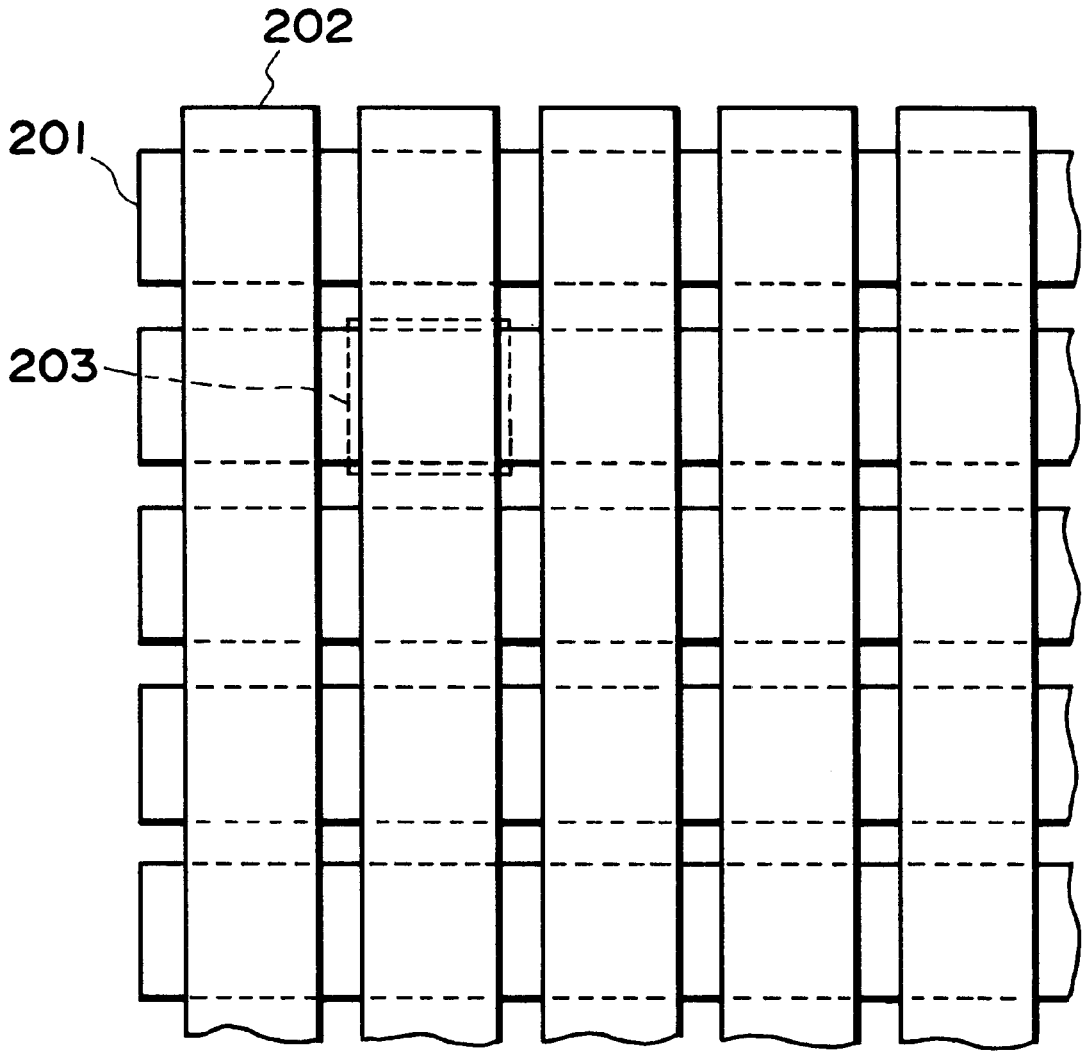
FIG. 2 is a schematic plan view showing a matrix electrode structure of a display portion (panel) of the liquid crystal apparatus shown in FIG. 1.

FIG. 2 is a schematic plan view showing an electrode structure of the display portion 101 shown in FIG. 1.

Referring to FIG. 2, a group of scanning electrodes 201 in a stripe shape and a group of data electrodes 202 in a stripe shape intersect with each other at right angles so as to form a plurality of pixels at each intersection, of the scanning electrodes 201 and the data electrodes 202, corresponding to one pixel 203.

Figure 3:
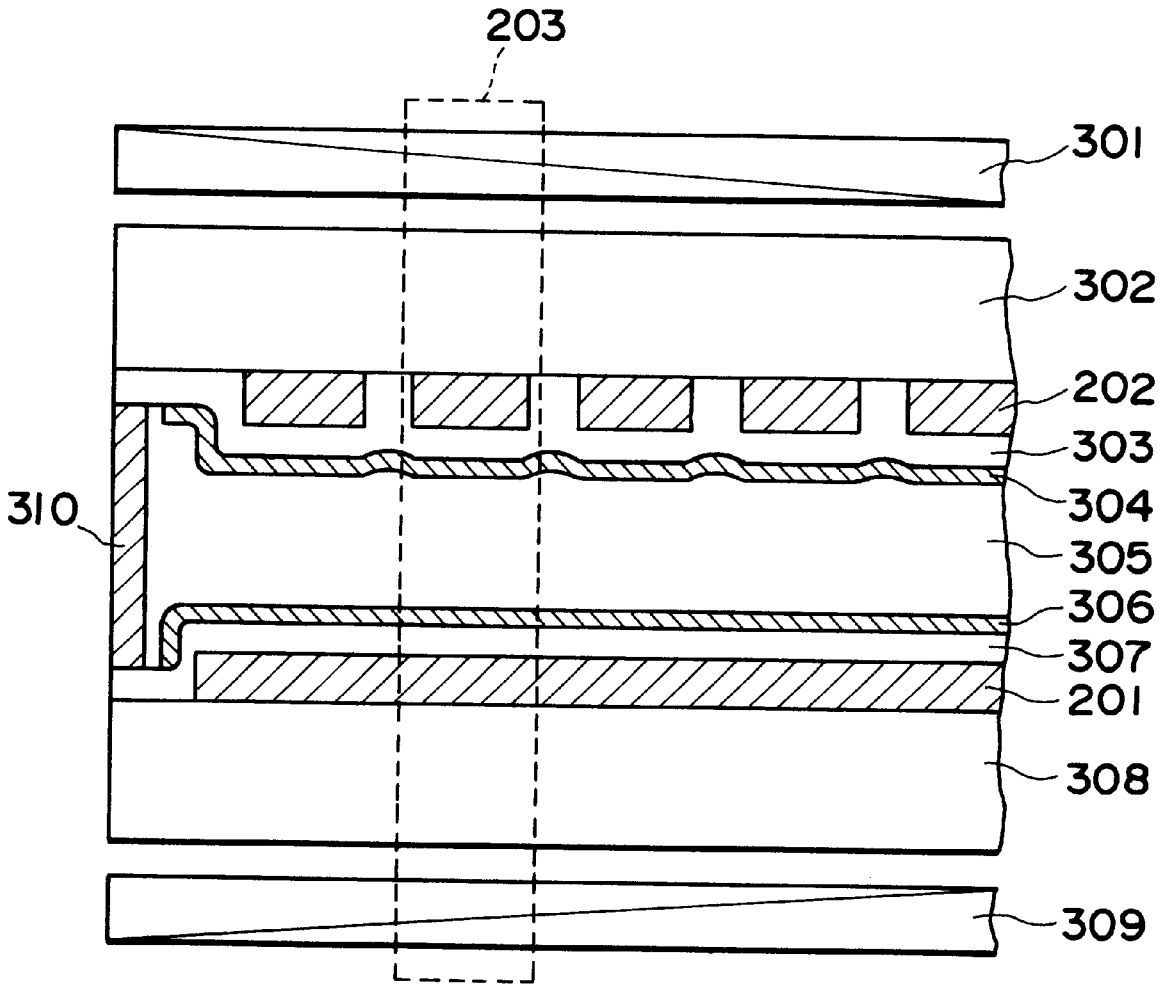
FIG. 3 is a schematic sectional view of the display portion of the liquid crystal apparatus shown in FIG. 1.

FIG. 3 is a schematic sectional view showing a part of the display portion 101 shown in FIG. 1.

Referring to FIG. 3, the display portion (liquid crystal device) 101 includes a pair of substrates 302 and 308 of, e.g., glass; the data electrodes 203 and the scanning electrodes 201 disposed on the substrates 302 and 308, respectively; insulating films 303 and 307 disposed on the data and scanning electrodes 202 and 201, respectively; alignment (control) films 304 and 306 disposed on the insulating films 303 and 307, respectively; a chiral smectic liquid crystal 305 (e.g., a ferroelectric liquid crystal) disposed between the pair of substrates 302 and 308 (exactly between the alignment films 303 and 307); and a sealing agent 310 disposed between the insulating films 303 and 307 at the periphery of the substrates 302 and 308. Outside the substrates 302 and 308, an analyzer 301 and a polarizer 309 are disposed in a cross nicol relationship so as to provide a dark state when the liquid crystal is placed in a U2 state.

The liquid crystal display apparatus as shown in FIGS. 1–3 may be used as a multi-color display apparatus by dividing each (one) pixel into three sections (sub-pixels) provided with a color filter of different three colors (e.g., red (R), green (G) and black (B)).

Figure 11:
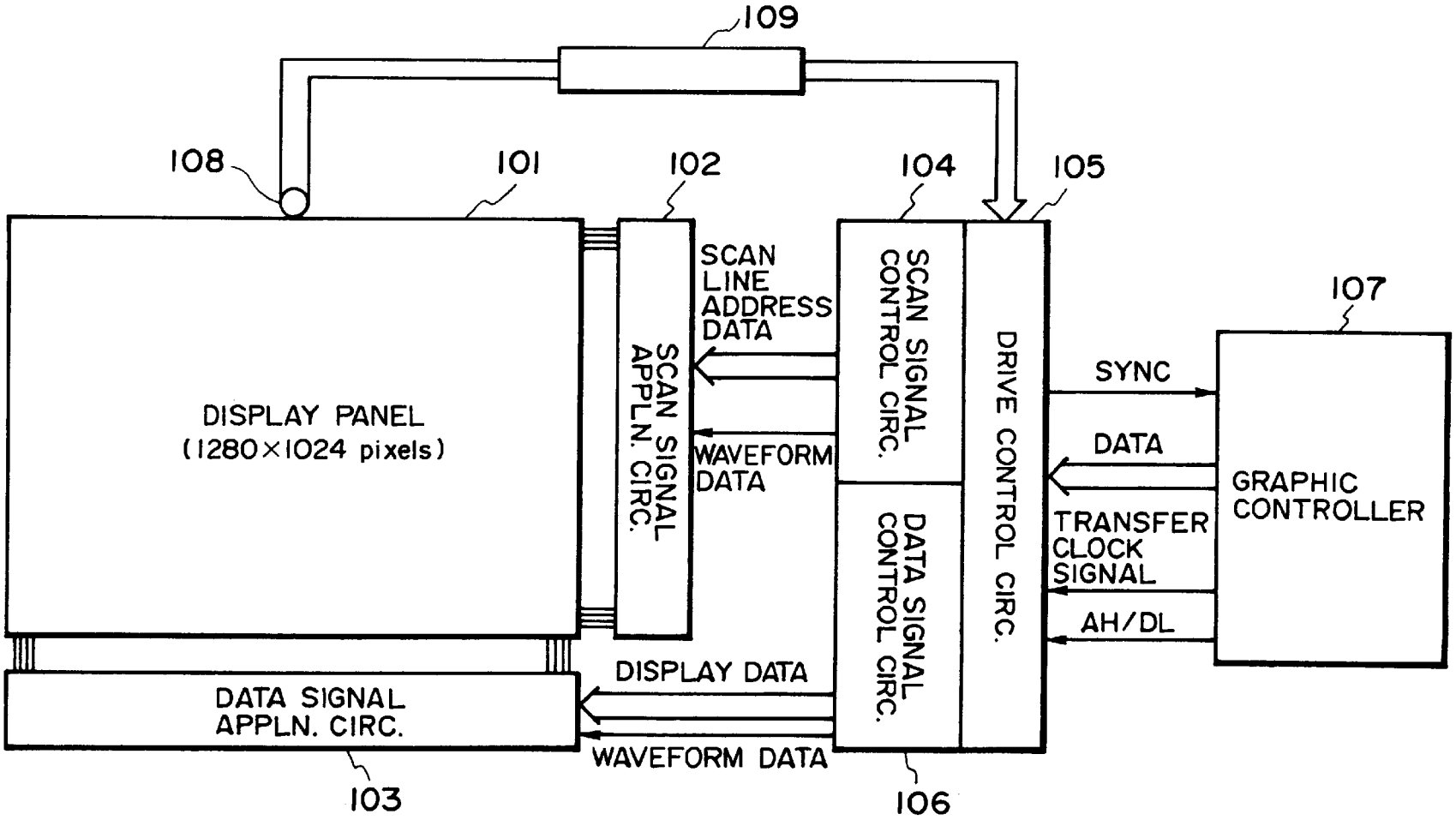
FIG. 11 is another block diagram of a liquid crystal apparatus of the present invention.

FIG. 11 is a block diagram of another embodiment of a liquid crystal display apparatus including a liquid crystal device as a display portion or panel driven by the driving method according to the present invention.

Referring to FIG. 11, the data signals may principally be transmitted in the same manner as in the display apparatus shown in FIG. 1.

The display apparatus shown in FIG. 11 further includes a temperature detection device (element) 108 for detecting a temperature (data) of the display portion 101 and inputting the temperature data to a temperature detection circuit 109. Based on the temperature data, the drive control circuit 105 supplies waveform data to the scanning signal application circuit 102 and the data signal application circuit 103 via the scanning signal control circuit 104 and the data signal control circuit 106, respectively.

More specifically, with respect to the temperature of the display portion 101, at least two temperature regions not overlapping with each other are set to be detected by the temperature detection device 108. Although the respective temperature regions vary depending on the chiral smectic liquid crystal used, the higher temperature region may generally be set to at least 40° C. (e.g., 45° C.) in its chiral smectic phase.

When a higher temperature (a temperature in the higher temperature region in a chiral smectic phase) is detected by the temperature detection device 108 and inputted to the temperature control circuit 109 as temperature data, based on the temperature data, the drive control circuit 105 supplies waveform data to the scanning and data signal application circuits 102 and 103, respectively, so that a writing pulse waveform applied to the liquid crystal at a selected pixel has a waveform for the pulse $P_3$ as shown in FIG. 9 wherein the higher voltage portion is sandwiched between the pair of lower voltage portions. Based on the waveform data, the display portion 101 is driven.

The liquid crystal device used in the present invention may be used as, e.g., an optical shutter having a single pixel.

Hereinbelow, the present invention will be described more specifically based on Examples.

EXAMPLE 1 AND COMPARATIVE EXAMPLE 1

A liquid crystal display apparatus shown in FIG. 1 was prepared by using a liquid crystal device (cell) as a display portion 101 having a diagonal length of 15 inches and 1280×1024 pixels.

The liquid crystal device had a matrix electrode structure shown in FIG. 2 and a cell structure shown in FIG. 3 and was prepared in the following manner.

One glass substrate 308 was coated with a 70 nm-thick ITO (indium tin oxide) film by sputtering and the ITO film was formed into a group of stripe-shaped transparent electrodes 201, which were coated with a 120 nm-thick insulating film 307 of tantalum oxide. Onto the insulating film 307, a 1 wt. %-solution of a polyimide precursor (polyamic acid "LP-64", mfd. by Toray K. K.) in a mixture solvent (N-methylpyrrolidone (NMP)/n-butylcellosolve (n-BC)=2/1) was applied by spin coating at 2700 rpm for 20 sec. The thus prepared substrate was dried in an oven at 80° C. for 5 min. and cured in the oven at 200° C. for 1 hour to form a ca. 10 nm-thick polyimide film. The polyimide film was rubbed two times in one direction with a nylon cloth wound about a 10 cm-dia. roller under conditions including a rotation speed of 1000 rpm, a pressing depth of 0.4 mm, and a substrate feed speed of 10 mm/sec., to obtain an alignment (control) film 306.

Onto the thus treated substrate 308, a 0.008 wt. %-dispersion of silica beads (not shown) of 2.0 $\mu$m in average particle size is isopropyl alcohol (IPA) was applied by spin coating at 1500 rpm for 10 sec. to spread the silica beads over the substrate at a density of ca. 300 particles/$mm^2$.

On the other glass substrate 302, a group of stripe-shaped transparent electrodes 202 was formed in the same manner as above and was further coated with a film by spin coating with a 0.5 wt. %-solution in ethyl alcohol of a silane coupling agent (ODS-E, octadecylsiloxyethane) at 2700 rpm for 20 sec. to form an alignment (control) film 304 for homeotropic alignment. On the periphery of the thus prepared substrate 302, a sealing agent 310 of a thermosetting epoxy resin was applied by printing. Incidentally, on the substrate 302, an insulating film 303 was not formed in this example.

The thus prepared two substrates 302 and 308 were applied to each other and hot-cured in the oven at 150° C. for 90 min. to prepare a blank cell.

The blank cell was filled with a chiral smectic (ferroelectric) liquid crystal showing the following phase transition series and properties (Table 1), thus preparing a liquid crystal device (cell) having a cell thickness of ca. 2.0 $\mu$m.

TABLE 1

| Phase transition temperature (° C.) | | |
|---|---|---|
| 94 | 60 | <30 |
| Iso. → SmA* | → | SmC* → Cryst. |
| Spontaneous polarization (Ps) | | |
| 27.0 nC/cm$^2$ at 30° C. | | |
| Tilt angle (Ⓗ) | | |
| 25.2 degrees at 30° C. | | |

The above properties Ps and Ⓗ were based on values measured according to the following methods.

Measurement of Spontaneous Polarization Ps

The spontaneous polarization Ps was measured according to "Direct Method with Triangular Waves for Measuring Spontaneous Polarization in Ferroelectric Liquid Crystal", as described by K. Miyasato et al (Japanese J. Appl. Phys. 22, No. 10, L661 (1983)).

Measurement of Tilt Angle Ⓗ

A liquid crystal device was sandwiched between right angle-cross nicol polarizers and rotated horizontally relative to the polarizers under application of an AC voltage of ±30 V to ±50 V and 100 Hz between the upper and lower substrates of the device while measuring a transmittance through the device by a photomultiplier (available from Hamamatsu Photonics K. K.) to find a first extinction position (a position providing the lowest transmittance) and a second extinction position. A tilt angle Ⓗ was measured as a half of the angle between the first and second extinction positions.

EXAMPLE 1

Figures 4A, 4B, 4C, 4D:
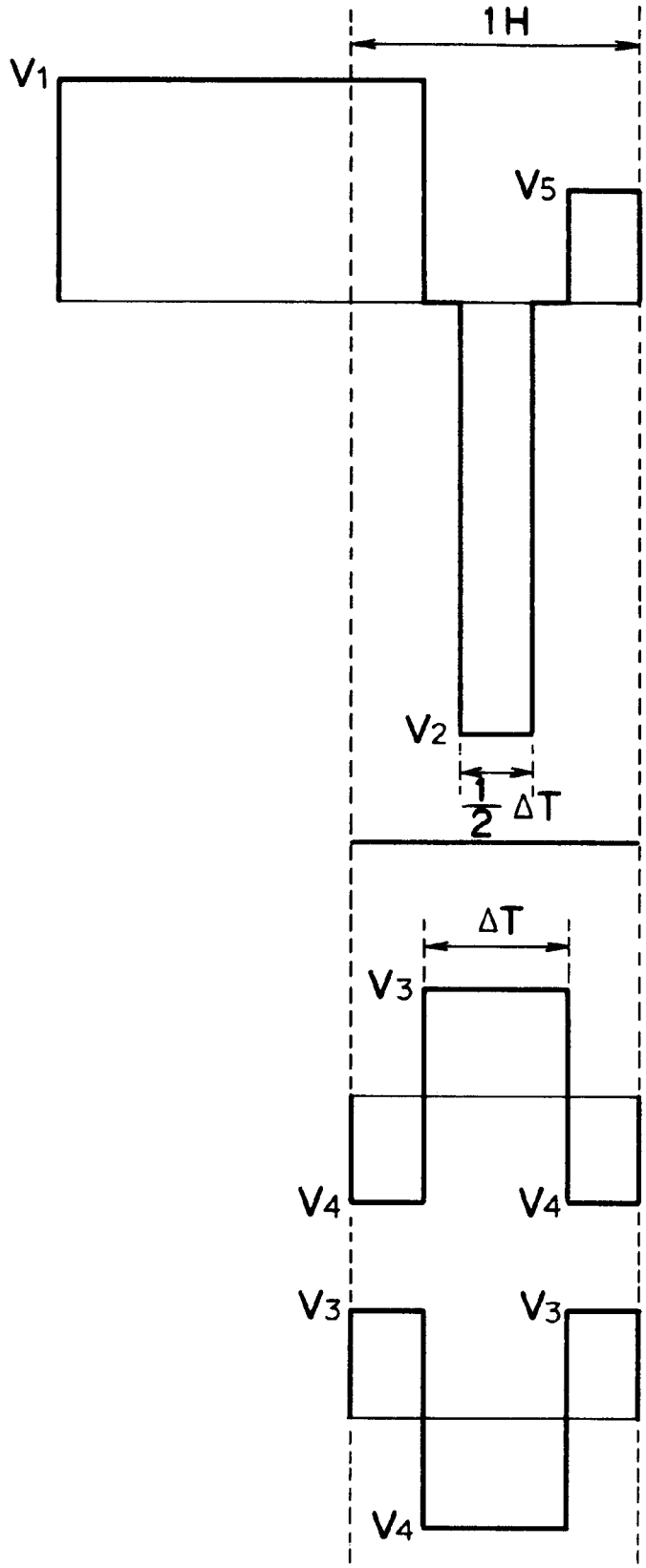
FIGS. 4A–4D and FIGS. 6A–6D are respectively a diagram showing a set of drive waveforms used in Example 1 appearing hereinafter.
Figures 5A, 5B:
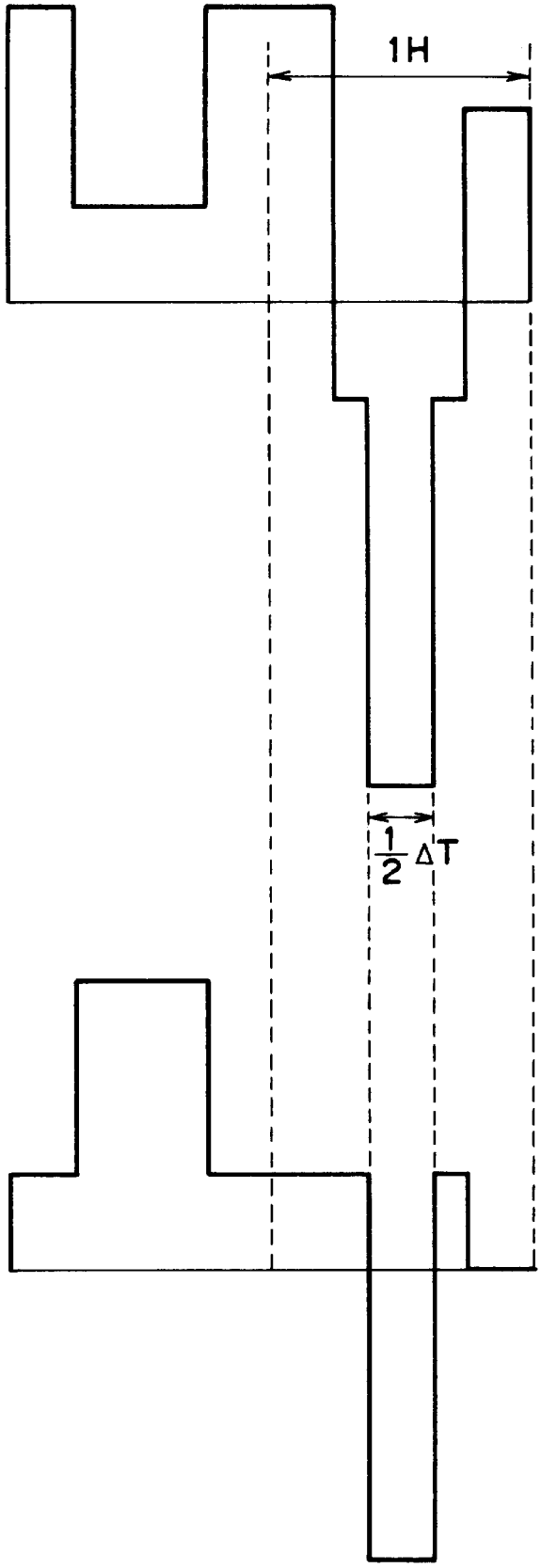
FIGS. 5A and 5B are respectively a diagram showing a combined waveform resulting from the drive waveforms shown in FIGS. 4A–4D.
Figures 6A, 6B, 6C, 6D:
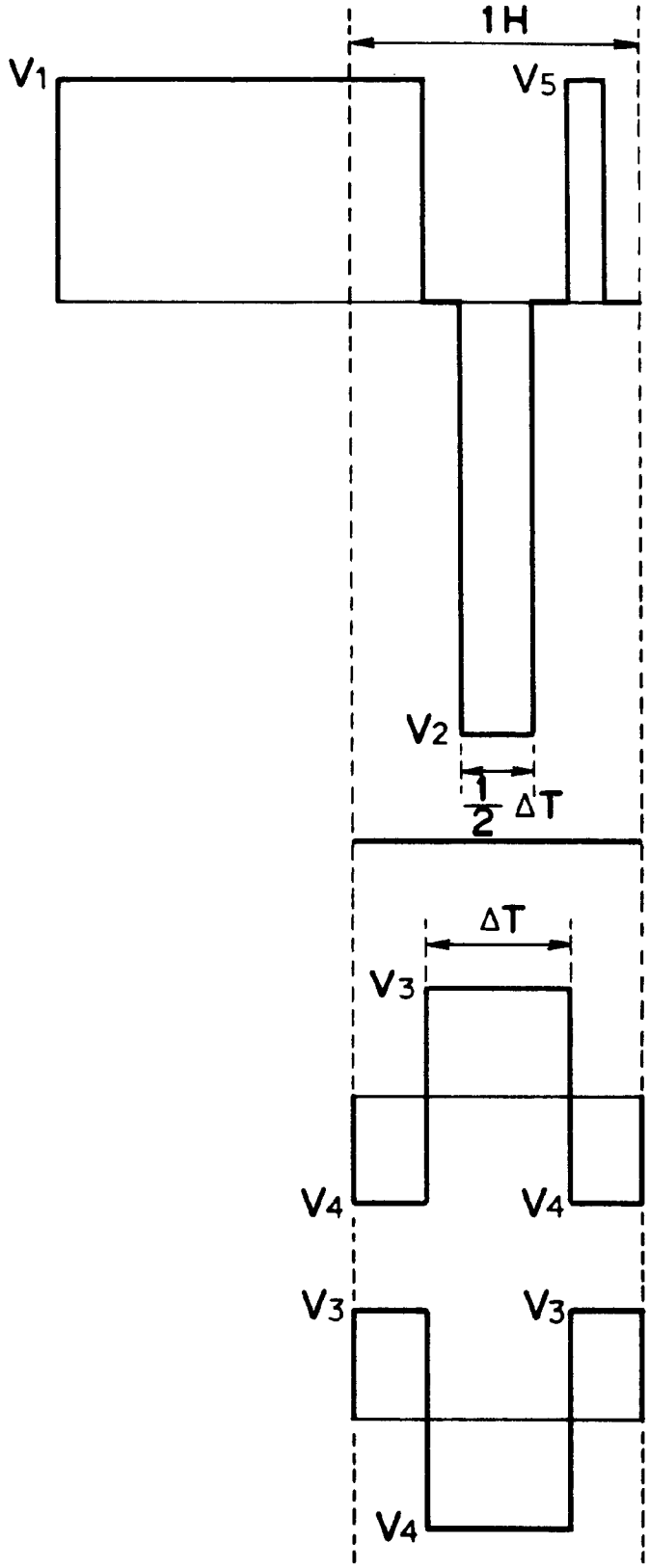

The above-prepared liquid crystal device was driven at 55° C. by applying a set of drive waveforms $W_1$ shown in FIGS. 4A to 4D and their combined waveforms shown in FIGS. 5A and 5B.

FIG. 4A shows a scanning selection signal (waveform) which includes a writing pulse having a pulse width (ΔT), a clear pulse having a pulse width (2.5ΔT) immediately before the writing pulse, and an auxiliary pulse having a pulse width (ΔT/2) immediately after the writing pulse. The writing pulse includes a higher voltage portion having a pulse width (ΔT/2) and a pair of lower voltage portions (no voltage portions in this example) each having a pulse width (ΔT/4) and sandwiching the higher voltage portion.

FIG. 4B shows a scanning non-selection signal (waveform) always having a voltage value of 0 (zero) volt (V).

FIG. 4C shows a data signal (waveform) for providing a bright (light) state which includes a writing pulse having a pulse width (ΔT) and a pair of auxiliary pulses sandwiching the writing pulse and each having a pulse width (ΔT/2).

FIG. 4D shows a data signal (waveform) for providing a dark state including a writing pulse and a pair of auxiliary pulses each having a pulse width identical to those for the data signal for the bright state an a voltage which is identical in value to those for the data signal for the bright state but is opposite in polarity to those for the data signal for the bright state.

In FIGS. 4A–4D, the pulse width (ΔT) of the scanning selection signal is synchronized with those of the data signals for the bright and dark states, respectively. Further "1H" represents one horizontal scan period or one-(scanning) line selection period and "ΔT" represents a selection period.

FIGS. 5A and 5B show combined waveforms each applied to each pixel when the scanning selection signal (FIG. 4A) is combined with the data signal for the bright or dark state (FIG. 4C or FIG. 4D). Specifically, FIG. 5A shows a combined waveform for providing a bright (light) state to a selected pixel based on a combination of the scanning selection signal (FIG. 4A) and the bright-state data signal (FIG. 4C). FIG. 5B shows a combined waveform for providing a dark state to a selected pixel based on a combination of the scanning selection signal (FIG. 4A) and the dark-state data signal (FIG. 4D).

In this example, the above-prepared liquid crystal device was driven (at 55° C.) by applying the above set of drive signals shown in FIGS. 4A–4D and FIGS. 5A and 5B. The respective pulses were characterized by parameters of $V_1$=7.2 (V), $V_2$=−14.3 (V), $V_3$=2.8 (V), $V_4$=−2.8 (V), $V_5$=3.2 (V), ΔT=16 (μsec) an 1H=32 (μsec) in FIGS. 4A–4D; and parameters of a voltage value of the higher voltage portion (having the pulse width of ΔT/2) of −17.1 (V) and a voltage value of each lower voltage portion (having the pulse width of ΔT/4) of −2.8 (V) in FIG. 5A (for providing the bright state).

In this example, the liquid crystal device was also driven at 55° C. by applying a set of drive waveforms $W_2$ shown in FIGS. 6A–6D under a condition including: $V_1$=7.2 (V), $V_2$=−14.3 (V), $V_3$=2.8 (V), $V_4$=−2.8 (V), $V_5$=7.2 (V), ΔT=16 (μsec) an 1H=32 (μsec).

COMPARATIVE EXAMPLE 1

The liquid crystal device was also driven at 55° C. by applying a set of conventional drive waveforms $W_3$ shown in FIGS. 7A–7D.

FIG. 7A shows a scanning selection signal (waveform) which includes a writing pulse having a pulse width (ΔT), a clear pulse having a pulse width (2.5ΔT) immediately before the writing pulse, and an auxiliary pulse having a pulse width (ΔT/2) immediately after the writing pulse. The writing pulse only includes a constant voltage portion (ΔT).

FIG. 7B shows a scanning non-selection signal (waveform) always having a voltage value of 0 (zero) volt (V).

FIG. 7C shows a data signal (waveform) for providing a bright (light) state which includes a writing pulse having a pulse width (ΔT) and a pair of auxiliary pulses sandwiching the writing pulse and each having a pulse width (ΔT/2).

FIG. 7D shows a data signal (waveform) for providing a dark state including a writing pulse and a pair of auxiliary pulses each having a pulse width identical to those for the data signal for the bright state an a voltage which is identical in value to those for the data signal for the bright state but is opposite in polarity to those for the data signal for the bright state.

In FIGS. 7A–7D, the pulse width (ΔT) of the scanning selection signal is synchronized with those of the data signals for the bright and dark states, respectively. Further "1H" represents one horizontal scan period or one-(scanning) line selection period and "ΔT" represents a selection period.

In this example (Comparative Example 1), the liquid crystal device was driven (at 55° C.) by using the drive waveforms $W_3$ under two conditions (Conditions (1) and Condition (2)) shown below.

| Parameter | Condition (1) | Condition (2) |
|---|---|---|
| $V_1$(V) | 14.3 | 7.1 |
| $V_2$(V) | −14.3 | −7.1 |
| $V_3$(V) | 5.7 | 2.8 |
| $V_4$(V) | −5.7 | −2.8 |
| $V_5$(V) | 6.4 | 3.1 |
| ΔT (μsec) | 8 | 16 |
| 1H (μsec) | 16 | 32 |

As a results of the driving of the liquid crystal device by applying the drive waveforms $W_1$, $W_2$, $W_3$ (Condition (1)) and $W_3$ (Condition (2)), the liquid crystal device could effect a good display over the entire display region when the drive waveforms $W_1$ and $W_2$ (Example 1) were used.

The liquid crystal device caused an unevenness or irregularity in temperature (distribution) over the entire display region, particularly at a central portion and a peripheral portion, with respect to the drive waveforms $W_3$ (Condition (1)) (Comparative Example 1) and caused a lowering in contrast over the entire display region with respect to the drive waveforms $W_3$ (Condition (2)) (Comparative Example 1), thus failing to effect a good display with respect to both the drive waveforms $W_3$ (Conditions (1) and (2)).

The results of evaluation of drive margins (M2) and heat evolution are summarized in Table 2 below.

TABLE 2

| | (at 55° C.) | |
|---|---|---|
| Waveforms | Drive margin (M2) | Heat evolution |
| $w_1$ | 0.12 | A |
| $w_2$ | 0.12 | A |
| $w_3$ (Condition (1)) | 0.11 | B |
| $w_3$ (Condition (2)) | 0 | A |

Herein, the drive margin (M2) was measured by changing the pulse width (1H) under application of an associated drive voltage (|V2|+|V3|). Herein, if the drive margin (M2) is at least 0.1, the liquid crystal device is generally evaluated as a practically acceptable one allowing a good matrix driving.

The degree of heat evolution was evaluated based on values obtained from respective voltage values and pulse widths (ΔT). Specifically, the value for the degree of heat evaluation with respect to the drive waveforms $W_1$ was standardized as "1", and based on the value, respective values with respect to the other drive waveforms $W_2$, $W_3$ (Condition (1)) and $W_3$ (Condition (2)) were calculated and converted into standardized values, respectively. In Table 2, "A" represented no heat evaluation state providing a standardized value below 3 and "B" represented a heat evaluation state providing a standardized value of at least 3.

EXAMPLE 2 AND COMPARATIVE EXAMPLE 2

A liquid crystal device was prepared in the same manner as in Example 1 and used as a display portion 101 (diagonal length=15 in., 1280×1024 pixels) of a liquid crystal display apparatus shown in FIG. 11 including a temperature detection device (element) 108 and a temperature control circuit 109.

The liquid crystal display apparatus included a scanning signal application circuit 102 and a data signal application circuit 103 each designed to apply a voltage in a range of 14.3 (V) to −14.3 (V).

The liquid crystal device was driven by applying sets of driving waveforms $W_1$ and $W_3$ under the following conditions at 55° C. or at 30° C., respectively.

| | (Example 2) | | (Comp. Example 2) | |
|---|---|---|---|---|
| Parameter | $W_1$ (55° C.) | W1 (30° C.) | W3 (55° C.) | W3 (30° C.) |
| $V_1$(V) | 7.2 | 7.2 | 14.3 | 14.3 |
| $V_2$(V) | −14.3 | −14.3 | −14.3 | −14.3 |
| $V_3$(V) | 2.8 | 2.8 | 5.7 | 5.6 |
| $V_4$(V) | −2.8 | −2.8 | −5.7 | −5.6 |
| $V_5$(V) | 3.2 | 3.2 | 6.4 | 6.4 |
| ΔT (μsec) | 16 | 16 | 8 | 24 |
| 1H (μsec) | 32 | 72 | 16 | 48 |

As a result, the liquid crystal device could effect a good display over the entire display region with respect to the diving waveforms $W_1$ at 55° C. and at 30° C. and the driving waveforms $W_3$ at 30° C., but caused a temperature unevenness over the entire display region, thus failing to effect a good display with respect to the drive waveforms $W_3$ at 55° C.

Other evaluation results (drive margin (M2), heat evolution and speed) are summarized in Table 3 below.

TABLE 3

| Ex. No. | Waveform | Drive margin (M2) | Heat volution | Speed |
|---|---|---|---|---|
| Ex. 2 | $W_1$ (55° C.) | 0.12 | 1.0 | A |
| Ex. 2 | $W_1$ (30° C.) | 0.20 | 0.4 | B |
| Comp. Ex. 2 | $W_3$ (55° C.) | 0.11 | 8.3 | A |
| Comp. Ex. 2 | $W_3$ (30° C.) | 0.19 | 2.7 | A |

The evaluation for the drive margin (M2) and the degree of heat evolution was performed in the same manner as in Example 1.

The evaluation for the (response) speed was performed based on a reference value for 1H (allowing a sufficient drive margin and as a minimum value for high-speed driving) of 50 μsec. In Table 3, "A" (for speed) represented a higher speed providing a 1H value of below 50 μsec, and "B" represented a lower speed providing a 1H value of above 50 μsec.

In these examples (Ex. 2 and Comp. Ex. 2), when the liquid crystal device was driven, the drive waveforms $W_1$ (55° C.) and $W_1$ (30° C.) (or $W_3$ (55° C.) and $W_3$ (30° C.)) were switched to each other based on a waveform-switching temperature of 45° C. Specifically, if the liquid crystal device showed a temperature below 45° C., the drive waveforms $W_1$ (30° C.) or $W_3$ (30° C.) was adopted. If the liquid crystal showed a temperature of at least 45° C., the drive waveforms $W_1$ (55° C.) or $W_3$ (55° C.) was adopted.

As described hereinabove, according to the present invention, by using drive waveforms including a writing pulse having a higher voltage portion and a pair of lower voltage portion sandwiching the higher voltage portion particularly at high temperature, it became possible to perform a good display with a larger (wider) drive margin (M2) while suppressing an increase in power consumption, irrespective of an ambient temperature.

What is claimed is:

1. A driving method for a liquid crystal device of the type comprising a pair of substrates and a chiral smectic liquid crystal disposed between the substrates so as to form at least one pixel, said driving method comprising:

detecting a temperature of the liquid crystal device by temperature detection means to determine whether the temperature is in a higher temperature range or a lower temperature range, and selectively applying a higher temperature-signal waveform to one selected pixel when the detected temperature is in the higher temperature range and applying a lower temperature-signal waveform different from the higher temperature-signal waveform to said one selected pixel when the detected temperature is in the lower temperature range, wherein the higher temperature-signal waveform comprises a clear pulse for placing the liquid crystal in a first state and a writing pulse subseqent to the clear pulse for selectively placing the liquid crystal in a second state depending on input data, and said writing pulse comprises a higher voltage portion and a pair of lower voltage portions sandwiching the higher voltage portion.

2. A driving method according to claim 1, wherein the higher voltage portion has a voltage value being at least two times a larger value of those of the lower voltage portions.

3. A driving method according to claim 1, wherein the higher voltage portion has a pulse width equal to or longer than a total pulse width of the lower voltage portions.

4. A liquid crystal apparatus, comprising a pair of substrates and a chiral smectic liquid crystal disposed between the substrates so as to form at least one pixel, temperature detection means for detecting a temperature of the liquid crystal device by temperature detection means to determine whether the temperature is in a higher temperature range or a lower temperature range, and signal waveform application means for selectively applying a higher temperature-signal waveform to one selected pixel when the detected temperature is in the higher temperature range and applying a lower temperature-signal waveform different from the higher temperature-signal waveform to said one selected pixel when the detected temperature is in the lower temperature range, wherein the higher temperature-signal waveform comprises a clear pulse for placing the liquid crystal in a first state and a writing pulse subsequent to the clear pulse for selectively placing the liquid crystal in a second state depending on input data, and said writing pulse comprises a higher voltage portion and a pair of lower voltage portions sandwiching the higher voltage portion.

5. A liquid crystal apparatus according to claim 4, wherein the higher voltage portion has a voltage value being at least two times a larger value of those of the lower voltage portions.

6. A liquid crystal apparatus according to claim 4, wherein the higher voltage portion has a pulse width equal to or longer than a total pulse width of the lower voltage portions.

* * * * *

UNITED STATES PATENT AND TRADEMARK OFFICE

CERTIFICATE OF CORRECTION

PATENT NO. : 6,452,581 B1 
DATED : September 17, 2002
INVENTOR(S) : Kazunori Katakura et al.

It is certified that error appears in the above-identified patent and that said Letters Patent is hereby corrected as shown below:

Title page,
Item [74], *Attorney, Agent, or Firm* "Fitzpatrick, Cella, Harper Scinto" should read -- Fitzpatrick, Cella, Harper & Scinto --.

Column 3,
Line 62, "closstalk" should read -- crosstalk --.

Column 4,
Line 14, "waveforms" should read -- waveform --.

Column 5,
Line 14, "intersection," should read -- intersection --.

Column 7,
Line 55, "an" should read -- and --.

Column 8,
Lines 16, 27 and 53, "an" should read -- and --; and
Line 66, "(Conditions" should read -- (Condition --.

Column 9,
Line 12, "results" should read -- result --.

UNITED STATES PATENT AND TRADEMARK OFFICE

CERTIFICATE OF CORRECTION

PATENT NO. : 6,452,581 B1 
DATED : September 17, 2002
INVENTOR(S) : Kazunori Katakura et al.

It is certified that error appears in the above-identified patent and that said Letters Patent is hereby corrected as shown below:

Column 10,
Line 21, “diving” should read -- driving --;
Table 3, “volution” should read -- evolution --; and
Line 63, “portion” (first occurrence) should read -- portions --.

Signed and Sealed this

Twenty-fifth Day of February, 2003

JAMES E. ROGAN
*Director of the United States Patent and Trademark Office*